US011072397B2

(12) United States Patent
Askestad

(10) Patent No.: US 11,072,397 B2
(45) Date of Patent: Jul. 27, 2021

(54) SUSPENSION OF TURRET BEARING UNITS

(71) Applicant: APL TECHNOLOGY AS, Kolbjørnsvik (NO)

(72) Inventor: Sigmund Askestad, Tvedestrand (NO)

(73) Assignee: APL TECHNOLOGY AS, Kolbjørnsvik (NO)

( * ) Notice: Subject to any disclaimer, the term of this patent is extended or adjusted under 35 U.S.C. 154(b) by 99 days.

(21) Appl. No.: 16/462,987

(22) PCT Filed: Nov. 22, 2017

(86) PCT No.: PCT/NO2017/000031
§ 371 (c)(1),
(2) Date: May 22, 2019

(87) PCT Pub. No.: WO2018/097732
PCT Pub. Date: May 31, 2018

(65) Prior Publication Data

US 2019/0308694 A1 Oct. 10, 2019

(30) Foreign Application Priority Data

Nov. 28, 2016 (NO) ..... 20161883

(51) Int. Cl.
*B63B 21/50* (2006.01)

(52) U.S. Cl.
CPC ..... *B63B 21/507* (2013.01)

(58) Field of Classification Search
CPC ..... B63B 21/507
See application file for complete search history.

(56) References Cited

U.S. PATENT DOCUMENTS 5,957,076 A 9/1999 Pollack et al.
6,164,233 A * 12/2000 Pollack ..... B63B 21/507 114/230.12

(Continued)

FOREIGN PATENT DOCUMENTS

NO 331838 B1 4/2012
WO WO 93/07049 A1 4/1993

(Continued)

OTHER PUBLICATIONS

International Bureau, International Search Report and Written Opinion in International Application No. PCT/NO2017/000031, dated Mar. 1, 2018.

*Primary Examiner* — S. Joseph Morano
*Assistant Examiner* — Jovon E Hayes
(74) *Attorney, Agent, or Firm* — Leydig Voit & Mayer, Ltd.

(57) ABSTRACT

A suspension of axial turret bearing units in a turret bearing comprises a rail support structure mounted on a turret bearing support structure, a circular rail mounted on the rail support structure, a plurality of axial bearing units running on rail, a shaft for each axial bearing unit with the bearing unit attached to the outer end of the shaft, and an inner support structure for supporting the inner end of each shaft. The suspension further comprises an outer shaft suspension close to each bearing unit, comprising a collar with an inner width similar to the width of the shaft and an inner height higher than the height of the shaft, a transitional section connected to the collar, a plate section connected to the transitional section and fastened to a bearing support structure on the turret, wherein the plate section spreads applied loads on the structure.

18 Claims, 7 Drawing Sheets

(56) References Cited

U.S. PATENT DOCUMENTS

| | | | | |
|---|---|---|---|---|
| 6,502,524 | B1 * | 1/2003 | Hooper | B63B 21/507 114/230.12 |
| 7,717,762 | B2 * | 5/2010 | Boatman | B63B 22/023 441/3 |
| 7,959,480 | B2 * | 6/2011 | Lindblade | B63B 22/025 441/3 |
| 8,671,864 | B2 * | 3/2014 | Lindblade | B63B 21/507 114/230.12 |
| 10,363,995 | B2 * | 7/2019 | Boe | F16C 27/04 |
| 2003/0154899 | A1 * | 8/2003 | Cottrell | B63B 21/507 114/230.12 |
| 2016/0083049 | A1 * | 3/2016 | Boe | B63B 35/4413 384/559 |
| 2019/0308694 | A1 * | 10/2019 | Askestad | B63B 21/507 |

FOREIGN PATENT DOCUMENTS

| | | | | |
|---|---|---|---|---|
| WO | WO 2011/036407 | A1 | 3/2011 | |
| WO | WO 2011/115505 | A2 | 9/2011 | |
| WO | WO-2011115505 | A2 * | 9/2011 | B63B 21/507 |
| WO | WO-2018097732 | A1 * | 5/2018 | B63B 21/507 |

* cited by examiner

SUSPENSION OF TURRET BEARING UNITS

CROSS-REFERENCE TO RELATED APPLICATIONS

This patent application is the U.S. National Stage of International Patent Application No. PCT/NO2017/000031, filed Nov. 22, 2017, which claims the benefit of Norwegian Patent Application No. 20161883, filed Nov. 28, 2016, which are each incorporated by reference.

TECHNICAL FIELD

This invention relates to offshore installations in particular to a system for handling the large wheel loads in a turret bearing system usually found at the surface termination of a riser on a turret mooring related to extraction of hydrocarbons. This is done without restraining the flexible properties of the shaft for the axial wheels, also providing an accurate positioning of the suspension points, favorable for the fatigue strength, and permits an in-situ replacement of all components in the wheel bearing system. A method for dismounting and mounting the wheels is also provided

BACKGROUND

Turret mooring systems have been in use for some decades and as the search for hydrocarbons has increased, the depth from which hydrocarbons can be extracted has increased. The risers coming from greater depths are associated with greater loads and the turret wheel bearings now have to handle hundreds of tons. If the turret wheel bearing fails production must stop. Because of this it is desirable to maintain the turret wheel bearing while operating or minimize the length of the stoppage. To this end a suspension for a turret wheel that can easily be maintained and exchanged under load is of great importance.

The background for this solution is to provide an improved suspension system for the axial wheel bearing system as described in (APL patent of turret bearing system) NO 331838.

It is important that all the bearing units in a large turret bearing system is contributing evenly in the load transfer from the turret to the vessel since the loads are large compared to the available room for the bearing system.

The said wheel bearing system is utilizing flexible shafts for good load sharing between the axial wheels. The axial wheels are transferring mainly the vertical components of the turret weight loads and the mooring and riser load effects.

The axial wheels will naturally due to friction effects also partake to some degree in the horizontal components of the turret loads as well. The radial bearing system will have some radial clearances and have some inherent flexibility. The turret will consequently move back and forth in the bearing system along with shifting directions of the wind, wave, current and dynamic load actions on the turret. The axial wheels as described below are therefore equipped with features allowing the turret with the shafts to slide horizontally relative to the wheels. The wheel bearings described below handles both rotation and movements of the wheel along the shaft. Horizontal, radial turret displacements, are thus setting up frictional reaction load forces in the axial bearing system, in a hub sliding bearing between the shaft and the wheel. These forces come in addition to the frictional torque resistance from the rotating wheel while subjected to high vertical loads.

Thus, the horizontal turret displacements which are limited by the clearances and displacement in the radial bearing system, are handled by the bearing in the hub of the wheel, so that the wheel is sliding along longitudinal direction of the shaft. These horizontal reaction loads from the sliding movement are transferred through the shaft to the anchoring point for the shaft at the inward shaft anchoring point. The outward support will only to a minor extent contribute to the horizontal reaction loads since the bearing support is significantly softer than the support structure in way of the inward shaft anchoring point. The support 21 is soft to horizontal loads mostly because of the thin portion. Brackets stiffening the support structure is best illustrated in FIG. 3, and are arrayed around the cylindrical shell. The torque arising from the rotation of the wheel is transferred both to the suspension structure and the inward shaft anchoring point.

Axial wheel bearing systems are designed to handle these horizontal turret loads in different ways. While the axial wheels as described herein are applying bearing bushings between the wheel and the shaft, some bearing systems are based on horizontal movements between the wheel and the rail, and special wheels may also handle these horizontal movements within the wheel itself. Anyway, the suspension system for the axial wheel bearing system as described herein is suitable for handling both all the horizontal and torque forces as well as the high vertical turret loads.

The turret radial bearing system is not further described below. However, a shaft based spring system for the radial bearing system may benefit just as much from using the same principles of shaft suspension as described in the axial bearing system.

The vertical loads in a turret system are immense while the available space for its footprint is expensive and limited. It is therefore required to ensure accurate positioning of the individual wheels in combination with a spring system suitable for handling the deviation in the actual vertical position of the individual bearing elements and the flatness of the rail on which the wheels are rolling. Flexibility is required, but flexibility for good load sharing and accuracy are features which in general contradict each other, low accuracy requires more flexibility than high accuracy does for the same skewed load distribution.

The turret bearing system is vital for the operation of off-shore, quite often permanently moored units. Regularity and safety requirements to turret bearing systems are high. The turret bearing is handling high loads and requirements for replacement of bearing units while operating and/or still being off-shore is increasing. Any decommission is very costly.

The high loads and requirements for flexibility require use of high strength steels in the structural supporting elements such as the shafts. Hence connections such as welding are beneficially avoided.

The objective with the suspension system as described herein for the axial wheel bearing system is improvements on the following features: accurate positioning of the suspension points both in unloaded and under extreme loads, providing smooth contact between supporting devices and the highly stressed shafts with limited resistance to its desired spring effects.

It is important for the bearing system that all the wheels are in very accurate position for good load sharing between the individual wheels since the capacity of them need to be fully utilized due to the high loads in the turret.

The shaft described in NO 331838 is supported by an elastomer pad. The advantage with the suspension system described below is that it is independent of elastomer materials. It is easier to obtain strict tolerances using a structural collar rather than an elastomeric pad. Elastomer pads are also susceptible to ageing.

WO 2011/036407 A1 describes a system for transferring major loads, in particular between a first unit (1) such as a floating unit with rotary mooring to a single point and a second unit (2) substantially immobile relative to the seabed and pivotably mounted in the first unit, such as a turret pivotably mounted in a well (3) passing through the shell of the floating unit, moored to the seabed, the system including an arrangement for guiding the turret including rotary elements inserted between the two units as well as a means for absorbing deformations, mainly of the first unit. The system is characterized in that the guide arrangement includes an axial abutment (9) which contains a large number of rotary elements (15), regularly distributed to form at least one crown (14) coaxial with the axis of rotation, and in that the rotary elements (15) are capable of deforming elastically in order to absorb said loads. The invention can be used for floating units with a single-point rotary mooring system.

The collar suspension system is advantageously combined with an anchoring suspension point 64 handling both vertical and axial loads, that is loads in the direction of the shaft in addition to the out of plane loads, horizontal loads transverse to the shaft.

The wheel shaft assembly as described below concerns one wheel sitting on a shaft. However, the same shaft suspension system may as well be combined with a shaft in combination with a bogie system comprising 2 to 4 wheels. A joint between the boggy and the shaft will then be required.

The suspension system as described for the turret arrangement is mounted on top of the turret structure as illustrated in FIG. 3; the turret with mooring system is hanging or suspended in the turret bearings.

The bearing with suspension system may as well beneficially be used on any large diameter, heavy rotary constructions on shore as well as offshore, independent of oil production or not.

The suspension system may also beneficially be used for bearing units as glide bearing pads as well as for wheels. The bearing pads will then be mounted with a spherical connection between the shaft and the pad which then will be sliding on a track.

SUMMARY OF INVENTION

The invention relates to a suspension of axial turret wheels in a turret bearing comprising a rail support structure mounted on a turret bearing support structure, a circular rail mounted to the rail support structure, a plurality of axial wheels running on the circular rail, a shaft for each axial wheel with the wheel attached to the outer end of the shaft and an inner support structure for supporting the inner end of each shaft.

The suspension of axial turret wheels in a turret bearing further comprises an outer shaft suspension close to each wheel comprising a flexible collar with an inner width similar to the width of the shaft and an inner height substantially higher than the height of the shaft, a transitional section connected to the collar, a plate section connected to the transitional section and fastened to a bearing support structure on the turret, wherein the plate section is large enough to spread the applied loads on said structure. Furthermore the suspension system comprises a releasable inner shaft anchoring point for connecting the shaft to the inner support structure, wherein the shaft is terminated just outside the inner support structure

BRIEF DESCRIPTION OF THE FIGURES

For better understanding of the invention the device will be described with reference to the figures. Like numerals describe like parts in the different figures.

DETAILED DESCRIPTION

Directions referred to in this text is related to a turret with a vertical central axis in operation at sea. Inner and outer is relative to the central axis unless otherwise stated. Although the text mostly refers to wheels (15) it should be under stood that also glide bearing assemblies (71) might be used instead of wheels. Wheels and glide bearing assemblies are two types of bearing units (15, 71)

Figure 1:
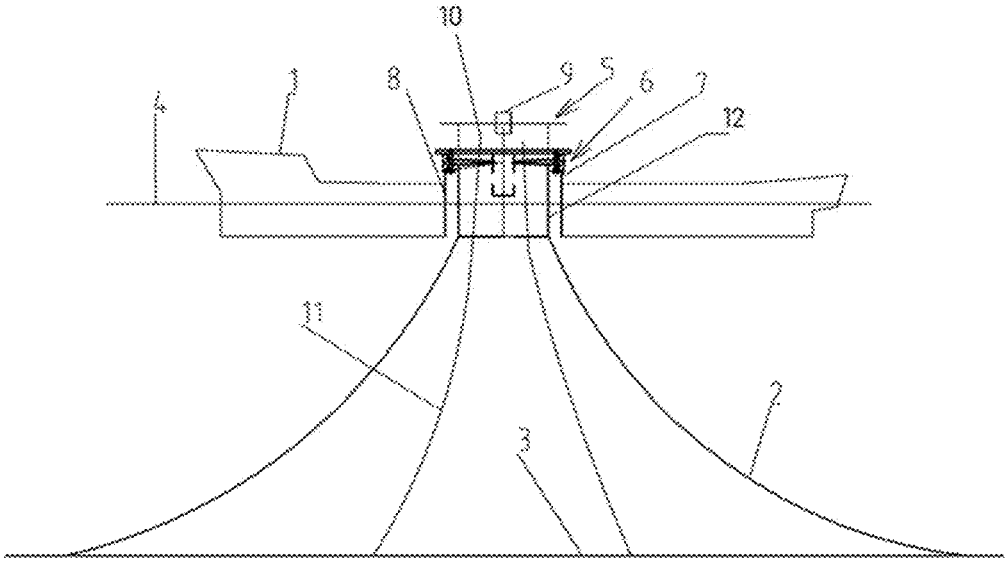
FIG. 1 shows a turret moored vessel.

FIG. 1 is showing a turret in a moored vessel 1. The turret 5 is geo stationary relative to the sea floor 3. Mooring lines 2 keep the vessel in position and the risers 11 connects the flowlines (not shown) on the sea floor with the vessel through the riser termination piping 10 in the turret through the rotary pipe connection (swivel) 9. The turret bearing 6 features an endless low-torque rotation of the vessel relative to the turret.

Figure 2:
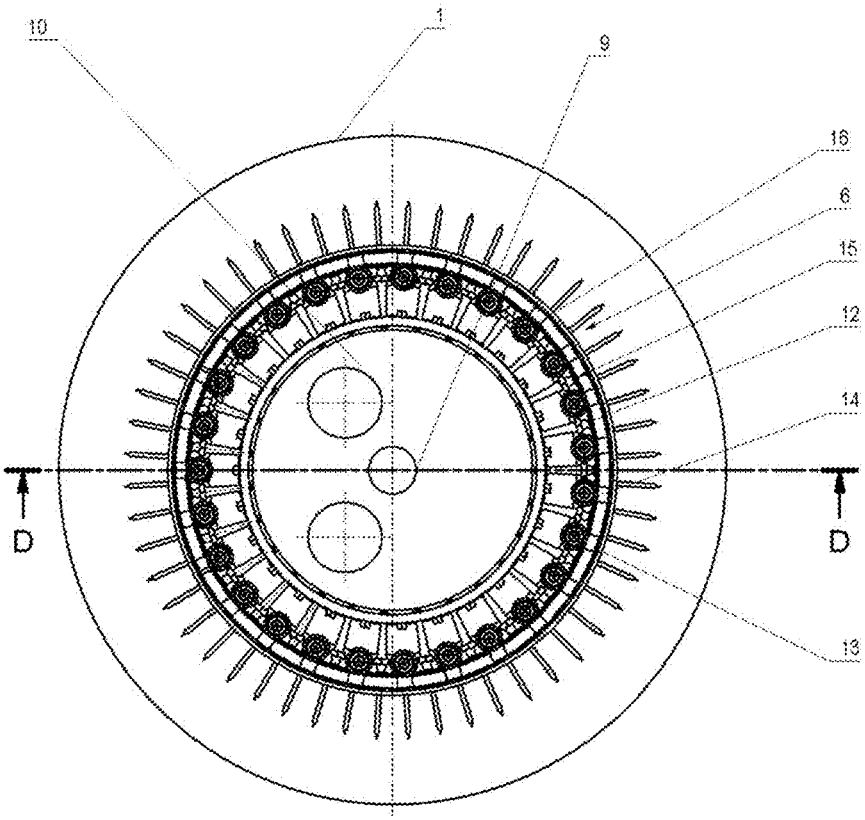
FIG. 2 shows a top view of a cross section of the turret wheel bearing with both horizontal and vertical wheels.
Figure 3:
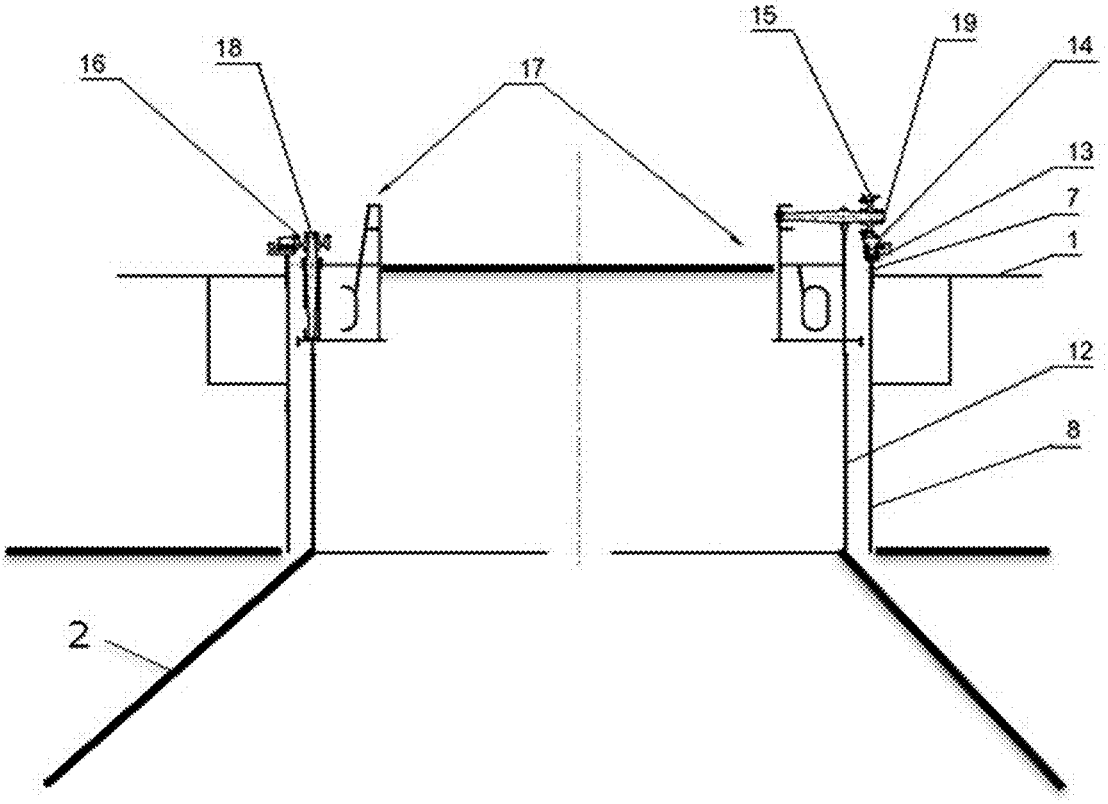
FIG. 3 shows a cross section of a turret bearing along the line D-D in FIG. 2.

FIG. 2 is showing a top view of the turret with bearing 6 and FIG. 3 is showing a section of the turret complying with the section line D-D in FIG. 2. In this embodiment the turret bearing includes an equal number of axial wheels 15 and radial wheels 16. The wheels are mounted on shafts 19 and 18 respectively. They are fixed to the turret bearing support structure 17 transferring the turret loads coming from the risers and mooring lines 2 through the wheels and onto the rail 14 supported by a rail support structure 13 on the vessel 1.

The turret bearing system includes here an equal number of axial wheels 15 and radial wheels 16. The wheels sit on shafts 19 and 18 respectively. The shafts are fixed to the turret bearing support structure 17 transferring the turret loads to the turret structure including the turret barrel 12.

The mooring lines are commonly fixed to the lower portion of the turret barrel as illustrated in FIG. 1 and FIG. 3 or extended all the way up to the upper portion of the turret.

The axial wheels are rolling on the upward facing part of the rail 14 (FIG. 8) and the radial wheels on the inward facing part of the rail 14. Both the axial and the radial wheels are beneficially rolling on the same rail for minimizing the relative movements within the bearing system (between the wheels and the rail). Such movements arise because of resilience in the bearing system, the turret tilts and moves horizontally and vertically subject to the dynamic loads affecting it.

Figure 4:
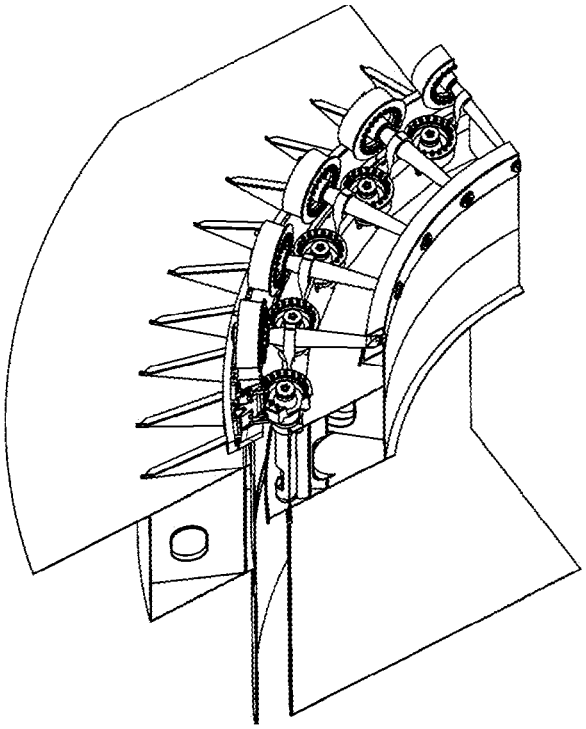
FIG. 4 shows a segment of the turret wheel bearing with a clear view of the wheels.

FIG. 4 is showing a quarter section of the wheel and rail bearing system with rail supporting system and wheel supporting system.

Figure 5:
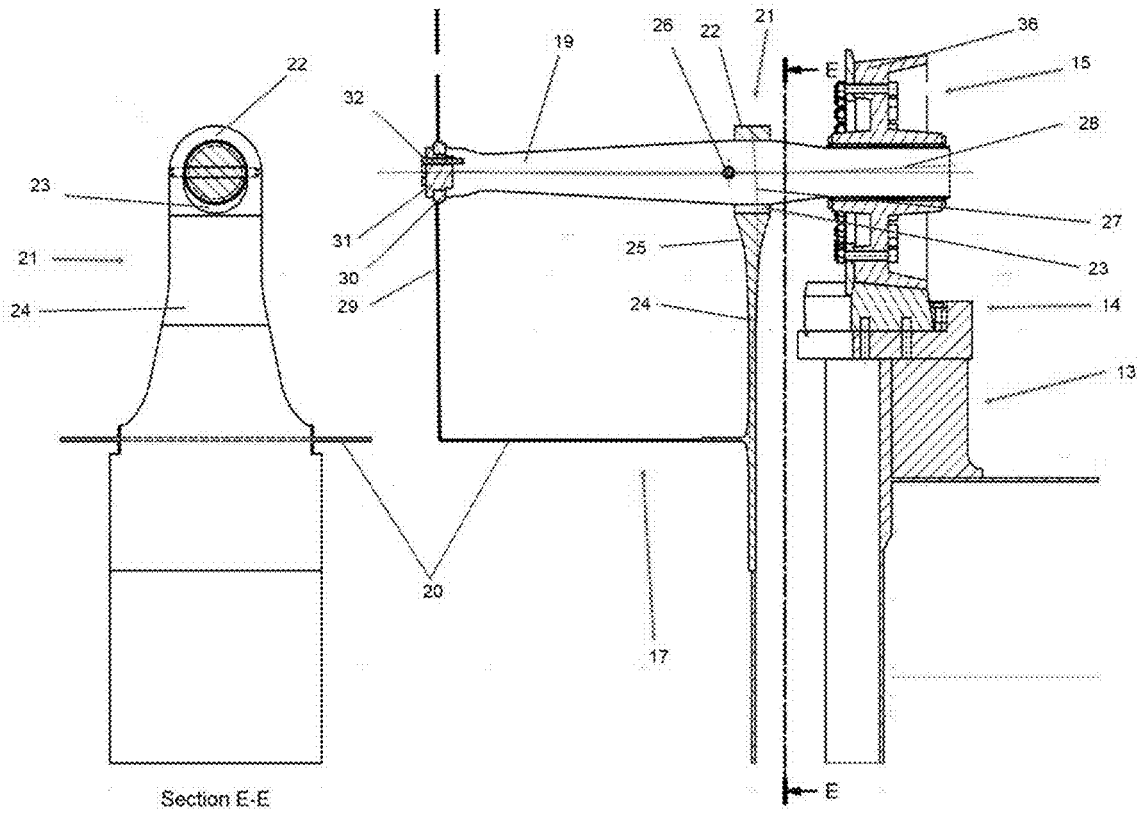
FIG. 5 shows a cross section of a shaft and wheel with an additional section E-E.

FIG. 5 is a section through the centerline of an axial wheel showing an axial wheel 15 with shaft 19 mounted into corresponding support structure 17 comprising an inner anchoring point 64 comprising a bolt connection fixing the inner shaft end to the support structure/turret. It also comprises an outer shaft suspension 21, which preferably is a collar type suspension, and a securing bolt 26 going through a hole 38 in the shaft, whose purpose it is to prevent the suspension 21 to move inward relative to the shaft 19. FIG. 5 also illustrates the deformation of the shaft 19 and outer shaft suspension 21 by the two lines A and B. The axial wheel 15 is rolling on a rail 14 supported by an underlying rail support structure 13, which in turn is supported by the turret bearing support structure 7. The load in the wheel is typically 50 to 200 tons, and the shaft deflects typically 5-20 mm at the wheel 15 relative to the turret barrel 12.

The length of the shaft is in the range of 1 to 3 m depending on load and required deflections. The required deflections depend on the tolerances for the bearing system, and is from a few mm (ab 5) up to 10-20 mm.

The shaft is preferably in a high strength low alloy steel, e.g. a CrMo steel, utilized at a high level for maximum spring effect for the wheel. It is then important that the shaft is smoothly machined without abrupt geometric changes and importantly without welding for good fatigue properties. The shaft has preferably a tapered cross section both toward the wheel and toward the inward support for maximum deflection for its length; obtained by a high utilization of the high strength material strength in its entire length, all the way from the wheel to the inner anchoring point 64.

The outer suspension structure 21, hereinafter called outer shaft suspension 21 features a connection to the shaft without the use of welding, and the shaft has a smooth surface even in way of its support in the collar part of the suspension made possible by using a collar type suspension. The opening 23 in the collar has a vertically elongated shape (as seen in the section E-E, defined in the sketch in FIG. 5) having a clearance fit width relative to the shaft, providing a stable hang off for the shaft, The geometry of the collar, wide and thin, yields the collar resilient to bending but strong to tension. Since the hole of the collar is made with the same diameter as the shaft, the circular shape of the collar will be maintained although, the collar part will thus beneficially be subjected to mainly tangential stresses. The height of the opening 23 is beneficially substantially larger than the shaft diameter for the purpose of giving room for the shaft on its way out during retrieval operations. This means that the shaft 19 may be pivoted in the collar 22 sufficient to leave the wheel still mounted on the shaft to be retrieved.

The thickness (measured along the shaft length) of the collar 22 is determined by the surface pressure between the collar and the shaft, and the stresses of the collar and add adequate stability to the shaft to prevent the collar to pivot around the outer edge of the collar. The thickness of the outer shaft suspension 21 is reduced gradually over a transition region 25 down to a thin plate-like structure 24, hereinafter called the plate section 24. Its width (section E-E) is getting substantially larger in the lower region for obtaining a support that is stiff with regard to forces in the transverse direction (horizontal forces transverse to the shaft). Thus the suspension point is beneficially kept fixed in its transverse direction ensuring correct shaft direction during operation, avoiding detrimental faulty wheel toe in and scuffing between the wheel and the rail.

Figure 6:
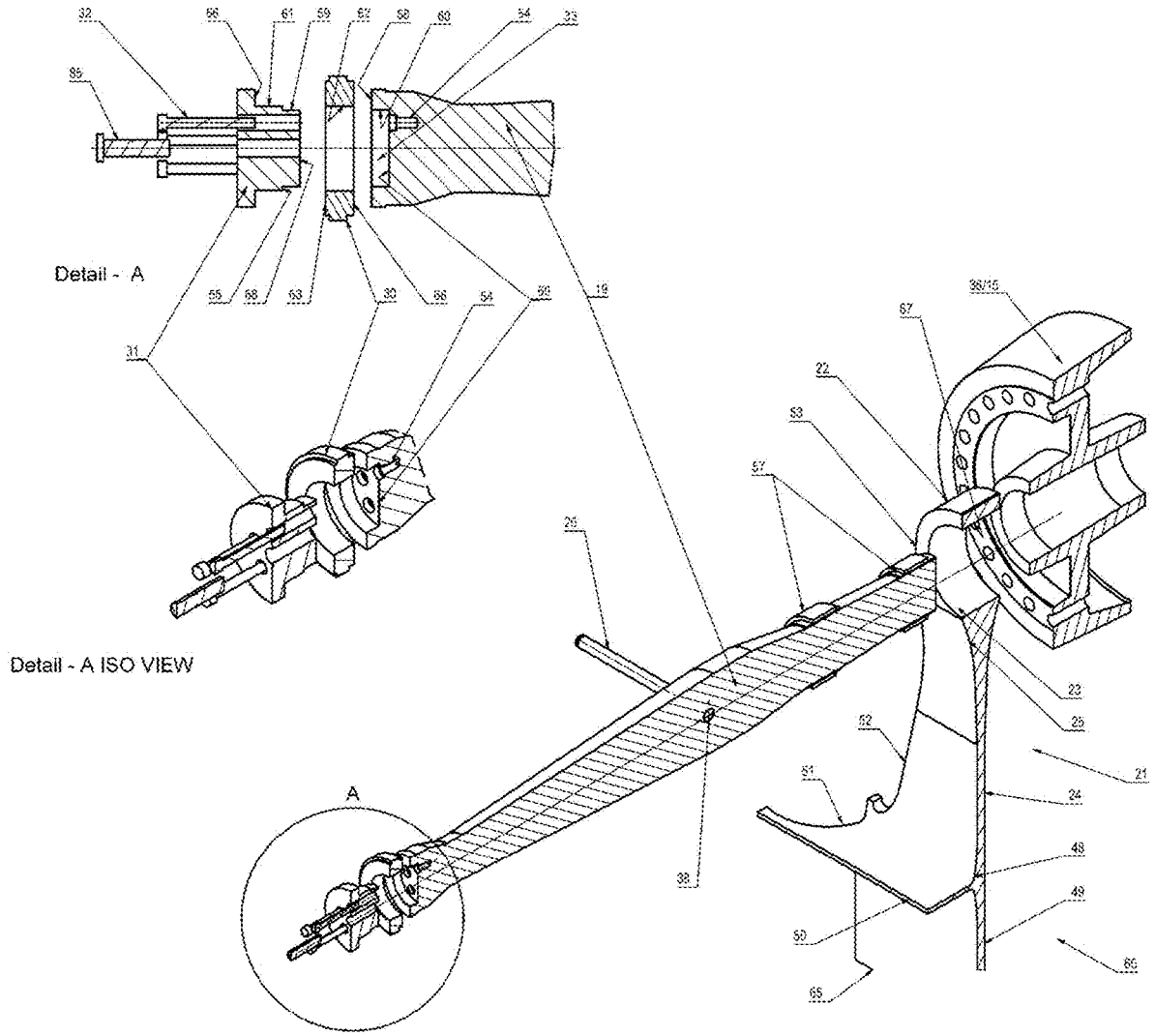
FIG. 6 shows a suspension of the shaft in more detail.

The thin plate section 24 is beneficially plane and extends most of the distance from the shaft to the support structure yielding a resilient suspension structure yielding moderate resistance to the intended said deformation of the shaft, which is illustrated with the line A in FIG. 5. The support structure 21 is also beneficially extended as one piece down into the substructure with structural branches downwards and inwards to have the weld joints in areas where the strain in the outer shaft suspension has been spread out on a larger cross sectional area. This geometry is illustrated by joints 50, 51, 65 (FIG. 6). The T-shaped joint where deck, turret barrel 5 and outer shaft suspension 21 meets in a transition area 48 is normally an area having both high stress concentration factors and poor fatigue properties simultaneously. These problems are mitigated by making the joint in one piece, with large fillet radiuses as part of the outer shaft suspension. The piece may either be in casted or forged steel for obtaining good fatigue properties. The joining welds are thus displaced away from the crucial area 48 away into simpler geometries to weld where the stresses are moderate.

The wheel load for a "small" turret (9 m diameter) is in the range of 100 to 150 ton, while the suspension load in the outer shaft suspension 21 is then in the order of 130 to 200 ton according to lever arms represented by the distance from the outer shaft suspension out to the wheel in comparison to the distance to the inner shaft anchoring point 64. The preferred length of the shaft depends on the turret arrangement, wheel loads and the machining tolerances of the bearing system. The length of the shaft ranges from 1 to a few meters, and the distance from the outer shaft suspension 21 to the wheel 15 is in the order of 0.25 to 1 m while the distance from the suspensions tie 21 to the inner anchoring point 64 is in the range 3-5 times the said distance to the wheel. The deflection of the wheel relative to the outer shaft suspension 21 is in the range of 5 to 15 mm depending on size, load and tolerance requirements of the turret.

The yield strength of the material in the shaft is typically in the range of 500-600 mPa strength which may be utilized in spite of the dynamic behavior in the turret loads since the forged, and advantageously non-welded, shaft is made with smooth surfaces for high fatigue strength. The outer shaft support will itself also contribute to the vertical spring effect of the axial wheel bearing system with a vertical deformation in the vertical direction in the range of 0.5 mm for a shaft system with a total vertical spring effect of about 10 mm, and is thus also contributing to the overall spring effect. The outer shaft suspension is also made in a forged material without welding in the highly stressed portions such as in the collar 22 around the shaft 19, and in the lower part of the transition 25 to the thinner plate section 24 where the combination of tension and bending effects have the largest effects on the outer shaft suspension.

It has thus been achieved a outer shaft suspension/device which is stiff regarding out of plane/transverse deflections, but resilient to vertical bending deformations in the shaft (ref. line A) while still handling the high suspension loads.

FIG. 5 is showing an axial wheel with shaft assembly as mounted into corresponding support structure comprising an outer (relative to the turret center) structural suspension device 21 and an inner shaft support 64 comprising a bolt connection fixing the inner shaft end to the support structure/turret.

FIG. 5 illustrates a section through the center plane of an axial wheel assembly 15 with shaft 19 mounted into the wheel bearing support structure 17. The axial wheel 15 is rolling on a rail 14 located on its rail support structure 13.

The shaft is fixed to the turret support structure 17 by the outer shaft suspension 21 and an inner shaft anchoring point 64 by means of a reinforcement 30 in the support structure 29 located at the inner end (relative to the turret center) of the shaft.

The inner end of the shaft 19 is clamped to a nut 31 by standard bolts 32. The mated shaft and the nut forms a groove as illustrated in Detail F in FIG. 6 and further described below. The reinforcement 30 is complementary shaped with said groove and provides an anchoring point axially and radially for the shaft. The shape of the groove seen in the direction of the shaft centerline may be circular or a polygon. The reinforcement 30 is clamped by bolting or welding to the inner part of the support structure 29. The shaft 19 is beneficially terminated on the outside of the support structure represented by the reinforcement 30 to ease the retrieval of the shaft as is illustrated in FIG. 5. Hence, the inner end of the shaft is beneficially not extending through the reinforcement 30.

The outer bearing outer shaft suspension 21 has a geometry as illustrated in the longitudinal section through the shaft and is shown on the right hand side in FIG. 5. The profile seen toward the turret center is shown the Section E-E in FIG. 5.

The shaft is located within a hole in the outer shaft suspension. The hole has the shape of a slot, with a width just a little larger than the diameter of the shaft, and a length in the downward direction substantially larger than the diameter of the shaft. The material surrounding the slot provides a large supporting contact surface between the shaft 19 and the outer shaft suspension 21. The upper part of the outer shaft suspension has a width and thickness providing suitable strength for transferring the loads in the shaft 19 to the lower portion of the outer shaft suspension 21. The lower portion of the outer shaft suspension 21 is a thin plate-like structure 24 extending downwards to the bearing support structure 17. The transition area 25 between the upper slotted part of the outer shaft suspension and the lower plate portion 24 is comprised of an area with a smooth change in thickness as illustrated in FIG. 6. FIG. 6 is an exploded ISO view of the wheel and support structures, and describes the supporting details for the shaft in the bearing support structure 17 in more detail:

The inner (relative to the turret center) end of the shaft 19 and the nut 31 is clamped together by the bolts 32. The axial position of the nut is accurately defined by the face 55 mating with the axial end face 58 of the shaft, since these two faces will be pressed together by when tensioning the bolts 32. The nut 31 has an axial face 63 with a defined distance from the axial face 55 to match the thickness of the reinforcement 30 for accurately positioning the shaft in the axial direction.

Accurate radial positioning of the shaft relative to the support structure at the inner supporting point is obtained firstly by accurate and fixed radial position of the nut relative to the shaft, secondly by accurate positioning of the shaft nut 31 assembly relative to the reinforcement 30.

The inner end of the shaft (on the turret) has beneficially a recessed portion 33 with a radial face 60 accurately centralizing the shaft with the nut's complementary face 59. Thus the nut 31 and the shaft 19 are locked relative to each other, both axially and radially, and behave as one unit relative to the reinforcement 30 which is fixed to the support structure 29, 17 by e.g. welding or bolts.

The faces 63, 61 of the nut and the larger diameter of the face 58 on the shaft constitutes a groove complementary shaped with the reinforcement 30. This features an anchoring point for the shaft nut assembly relative to the reinforcement with support structure 29. The radial face 61 is complementary to the radial face 62 of the reinforcement 30 and provides an accurate radial (vertical and horizontal) positioning of the shaft.

The outer support for the shaft also includes a securing pin 26 which is arranged in a hole 38 in the shaft inward of the collar portion of the outer shaft suspension. Its function is to keep the collar from sliding inward (away from the wheel) during operation. It is advantageously arranged in the shaft neutral axis where the stresses are the least.

Figure 7:
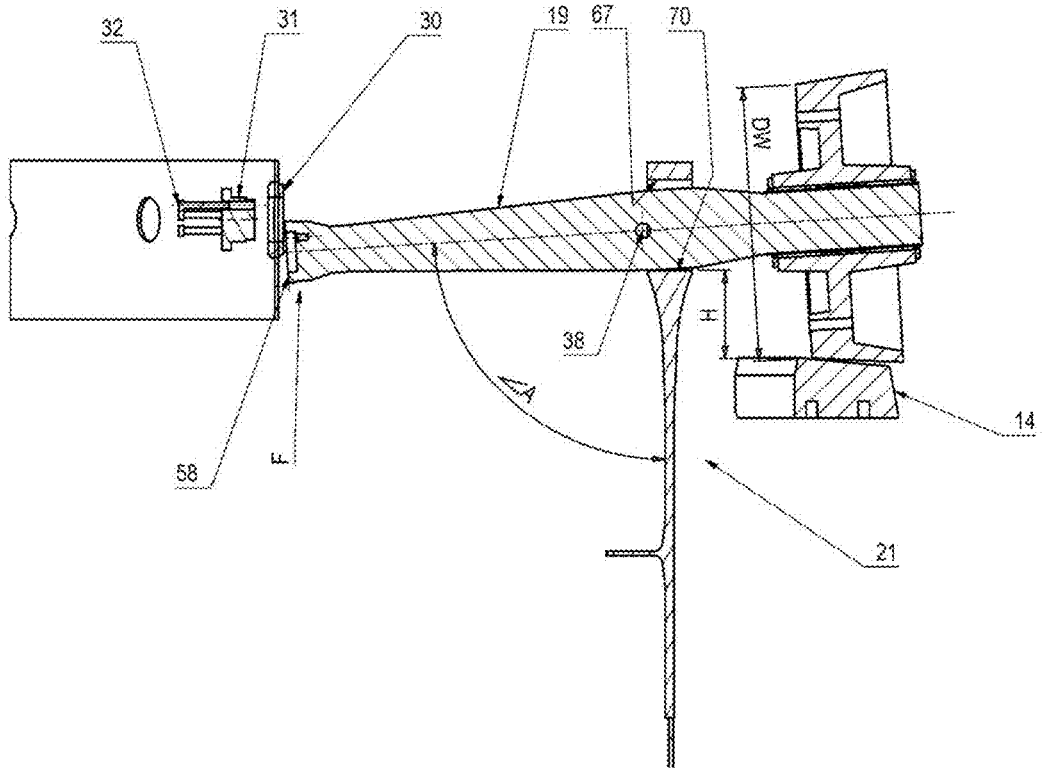
FIG. 7 shows a cross section of a shaft and wheel with nut and wheel flange dismounted for removal of the wheel and shaft.

FIG. 7 shows the principles for the retrieval of the wheel and the shaft. The wheel should not be retrieved while loaded. This will cause the surface of the rail and or the wheel to be damaged. Hence, it is required that the wheel is unloaded prior to its demounting. This may be done by retrieving the nut inward through the ring 30. The nut is retrieved by using a bolt 85 (see FIG. 6) for pushing the nut out from the shaft, and out through the reinforcement. The bolt may either be located in the center of the nut or there may be a couple of bolts located amongst the clamping bolts. The force required to push the bolt out is reduced by applying a load F onto the shaft as illustrated in FIG. 7. This force is provided by a jack 37 at that point. The shaft may be tilted down when the nut is retrieved out through the reinforcement by lowering the jack. The reaction load between the wheel and the rail is quickly 0 when the jack is lowered. The shaft is free to be pivoted to an angle A sufficient to give the wheel free way out, toward the right hand side in FIG. 7. The flange in FIG. 7 is removed prior to wheel retrieval. However, the flange may be left on if the angle A is a bit larger. The shaft will be pivoting about the lower face 70 of the collar.

The height of the opening in the collar is sufficient to allow the shaft to be pivoted an angle A.

Figure 8A:
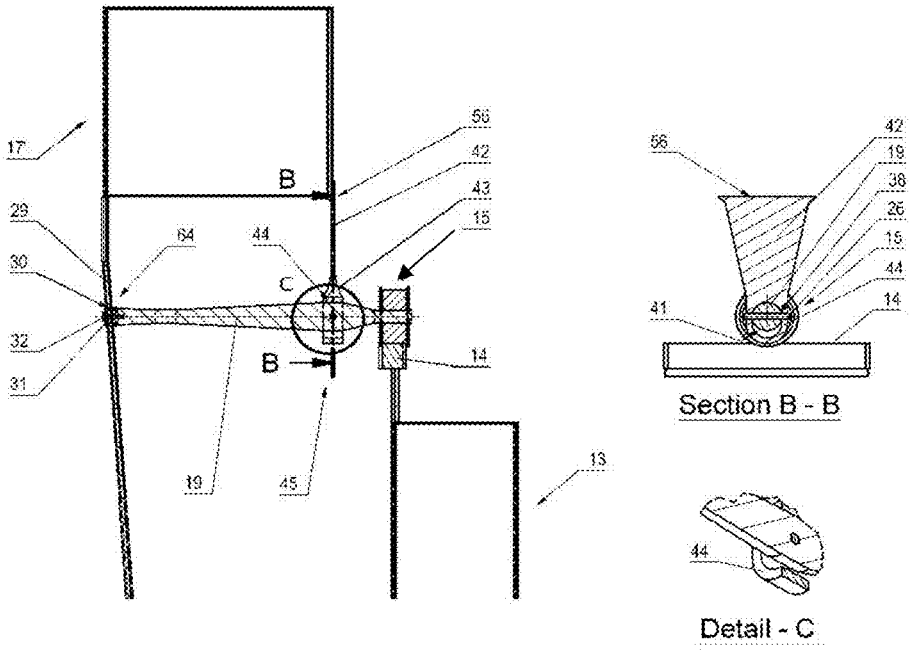
FIG. 8 a and b shows two different embodiments with main portion of the structure located above the bearing system.

FIG. 8 is illustrating an alternative configuration of the bearing support arrangement for the turret in FIG. 1 where the turret loads are transferred to the bearing system from above the level of the bearing system. This arrangement is therefore particularly suitable for turntables where a large portion of the turret structure is extending above the bearing level, particular systems such as illustrated in APL patent on turntable systems, NO19983291.

The geometry of the shaft, the wheel and rail system as well as the inward anchoring point 64 are equivalent or similar to those of the axial wheel bearing configuration in FIG. 5. It is also a beneficial substitute for the supporting system as described in FIG. 4A of the referred patent where an elastomer pad 16 is used for supporting the downward directed load from the turret structure (5 in referred APL patent).

FIG. 8 is showing an inverse upside down solution to FIG. 5 where the wheel bearing support structure 17' is arranged above the wheel bearing system. This system is in particular suitable for applications where the turret either extends far above the bearing system or for turntable systems as described in Ser. No. 19/983,291 where the major portion of the rotating structure is arranged above the bearing system.

The outer shaft support 45 is equivalent with the outer shaft suspension 21 except that it is turned upside down compared with the shaft suspension 21. Instead of transferring the applied load by suspension from underside, the load is transferred by compression from the top side of the bearing system by a support structure 45 extending from a bearing support structure 17' suitably located above the bearing system.

The shaft support 45 comprises in principles the same parts as for the outward shaft suspension 21, and with the same geometric principles except that the thin plate section 42 of the shaft support 45 need to be designed with due regard to buckling; A collar 44 for the shaft support 45 includes also a transition area 43 between the thick collar 44 and towards the thin plate section 42. This plate section as is depicted in Section B-B of FIG. 8 is favorably also extending both sides for suitable transverse stiffness of the outer shaft support, similar to the properties for the outer shaft suspension 21. The outer shaft suspension 45 is fixed to the support structure in the connection 56 advantageously also including a curved transition area 43 for smooth transfer of the reaction loads in the inverse outer shaft support. The shaft will in this version of collar connection be pressing upward, and the gap in the slotted opening of the collar will be on the underside of the collar as is illustrated in Detail C in FIG. 8.

The underside of the collar is useful for stiffening up the collar, and provides a lower threshold or support for the shaft when it is retrieved, equivalent with the situation for the shaft in FIG. 6. However, from a strength point of view the simpler version will suffice as illustrated in FIG. 8*b*.

Figure 8B:
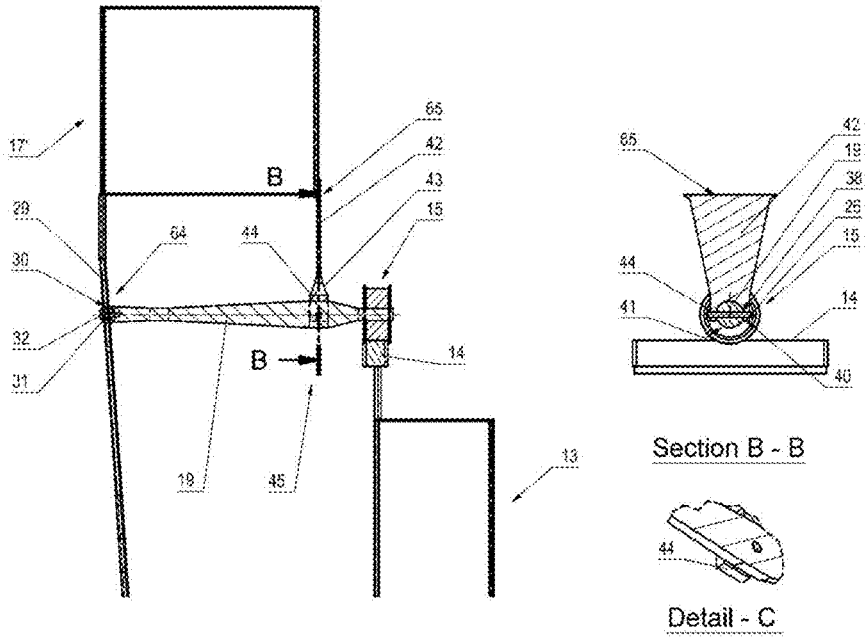

FIG. 8*b* is showing a simplified version of FIG. 8 where the collar in the outward support structure 45 has been cut some distance below the shaft as illustrated in section B-B in FIG. 7. The collar 44 is here just cut off in the middle of the opening. The collar thus display a U-shaped profile when looking in the direction of the shaft.

Figure 9:
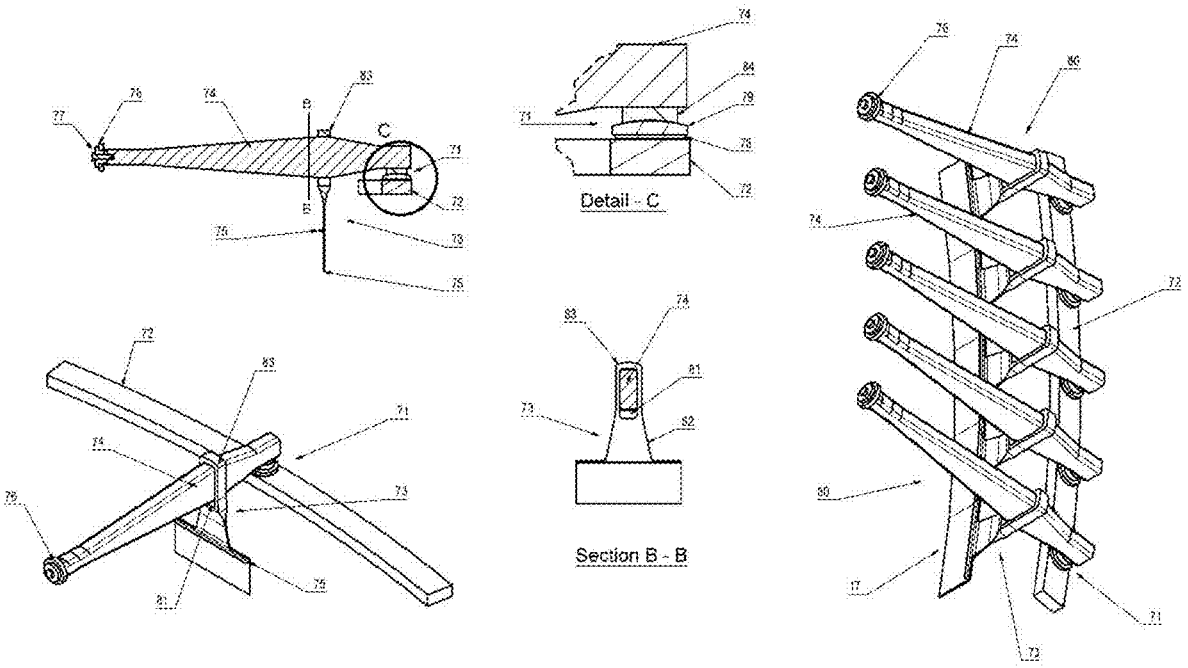
FIG. 9 shows an alternative embodiment with glide bearing pads instead of a wheel.

FIG. 9 shows an alternative embodiment of the invention. The glide bearing assembly 71 is comprised of a spherically supported gliding bearing pad which is connected to the outer end of the flexible shaft 74. The bearing pad assembly 71 includes at least a downward facing plane bearing pad 78 gliding on the circular glide path/glide way 72. A spherical bearing is fixed to the said pad on the upper portion of it as shown in detail C in FIG. 9. The spherical bearing is according to standard technology for such joints comprised of two discs. A lower one with an upward facing convex spherically shaped surface, and a second one with a complementary shaped concave spherically shaped disc, or arranged upside down.

The spherical joint ensures that the pad will always align with the glide way since the angular deformations in the shaft will be absorbed by the spherical joint. The joint will of course also handle any relative deformation on the upward facing glide surface of the circular glide way 72.

The shaft is in this example with a rectangular cross section, with a height substantially larger than the width. A circular profiled shaft might as well be used as was illustrated in FIG. 5 for the wheel bearing system. Likewise, the shafts used for the wheel bearing system may as well be based on shafts with a square profile.

The advantage with the rectangular cross section is the higher utilization of the material than for the circular cross section with regard to the substantial bending moments in the vertical plane caused by the high vertical loads. This is obvious when considering the sectional moment about the horizontal neutral axis for a rectangle as compared with a circular profile. A further advantage with regard to material utilization would be a H-profile turned 90 degrees.

The advantage with the circular profiled shaft is simpler fabrication and avoidance of a less fatigue resistant shape of the material in the region of transition from a non-circular cross-section to a circular cross-section where the wheels 15 are fastened. Further, a circular collar over a circular shaft is favorable compared with a collar with rectangular shaped opening complementary shaped with a shaft with a rectangle cross section. This is because the secondary stresses in a circular shaped collar subject to downward loads are lower than for a rectangular shaped collar for the same collar weight. Examples of collars subject to tension from downward loads are shown in FIG. 5 and in FIG. 9. The support structure with a collar as shown in FIG. 8 is subjected to loads from above, the suspension structure is mainly subjected to compressive stresses and the loads are transferred directly down to the shaft. The collar part will then only be exposed to small loads. For these cases, a rectangular shaped shaft will be reasonable.

The choice between rectangular shaped shafts vs circular shafts depends thus on a variety of aspects including such as type of bearing unit, size and loads, load transfer by suspension by hanging loads or support of loads from above.

Figure 10:
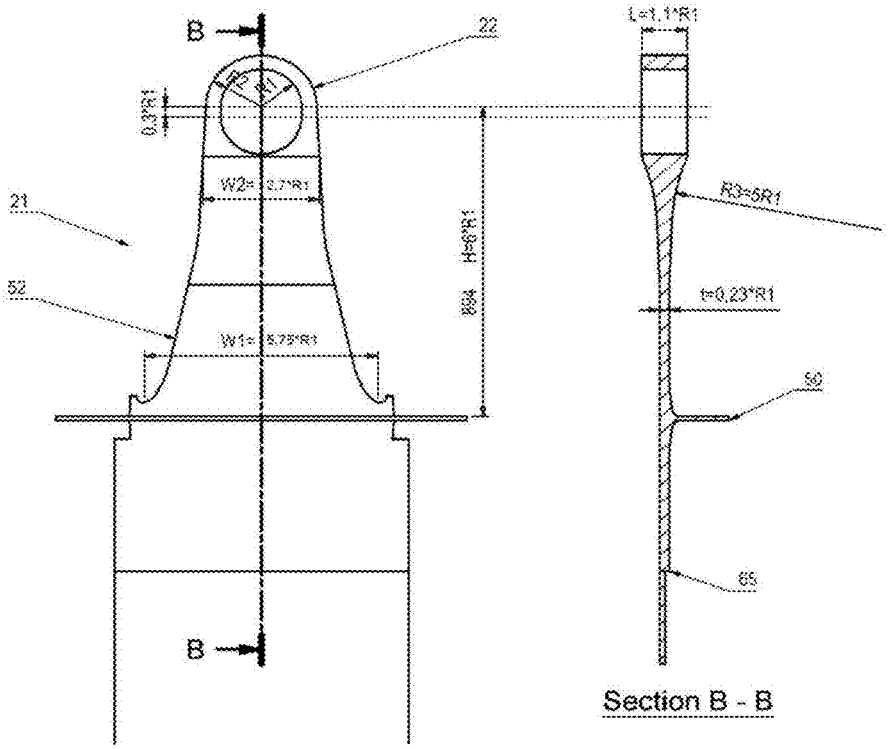
FIG. 10 shows typical preferred dimensions of a outer shaft suspension

FIG. 10 is showing the preferred embodiment for the suspension structure for a turret arrangement as depicted in FIGS. 3 and 4. The dimensions are given dimensionless as ratios relative to the shaft 19 diameter.

In an advantageous geometry of the outer shaft suspension 21 has a thickness L along the shaft 19 of about 1-1.2 times R1 where R1 is the radius of the collar. The radius R1 is made with a small clearance fit tolerance with the outer diameter of the shaft 19 in the contact zone between them. The outer shaft suspension is preferably made in one piece, however, it may also be assembled and joined/welded from smaller pieces at suitable locations.

Figure 11:
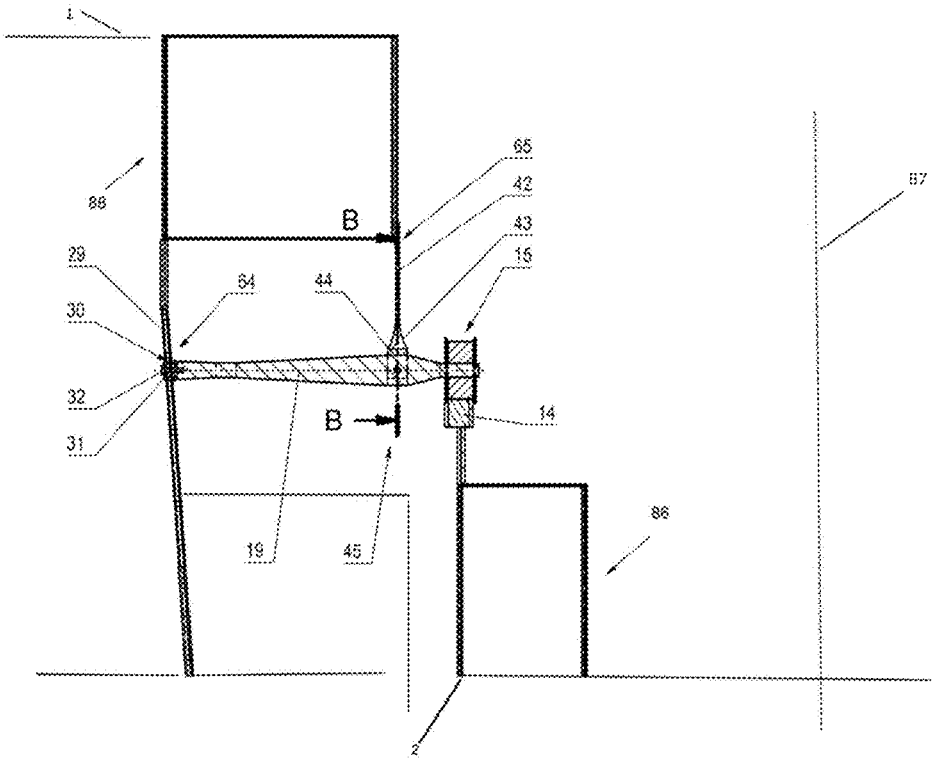

FIG. 11 is showing an alternative configuration where the rail is located on the turret 5 and the wheel with shaft suspension 21 arrangement is mounted onto the vessel. This configuration is in main principles equivalent with the turntable version in FIG. 8. The advantage with this solution is that there is more room on the turret for riser systems and so forth. It can be seen that the rail support structure 86 is on the turret 5 instead of the vessel and that the bearing support structure 88 is on the vessel instead of the turret. The line 87 is the centerline of the turret.

Definitions

1 vessel
2 mooring line
3 sea floor
4 water line
5 turret
6 turret bearing
7 turret bearing support structure
8 turret well in vessel
9 rotatable fluid/gas/power connection (swivel)
10 riser termination in turret
11 submarine riser
12 turret barrel
13 rail support structure
14 rail
15 axial wheel (turret bearing)
16 radial wheel (turret bearing)
17 bearing support structure
18 shaft for radial wheel
19 shaft for axial wheel
20 bearing deck

21 outer shaft suspension
22 collar, top part of the shaft suspension structure
23 gap between shaft and collar, underneath the shaft
24 plate section of suspension structure
25 transitional section between collar 22 and plate section 24
26 securing bolt
27 shape of deformed outward shaft suspension structure 21
28 deflected shape of shaft 19 when subject to loads in the axial wheel 15
29 inward support structure for axial wheel shaft
30 ring shaped reinforcement in the support structure located at the inward end of axial wheel shaft 19
31 nut for shaft 19 for axial wheel
32 bolts for clamping the nut 31 to the axial wheel shaft 19
33 recess in shaft inward end complementary to the nut 31
34 pivot point for the shaft in the collar when the shaft and wheel assembly is being retrieved
35 axial wheel assembly ex wheel flange
36 axial wheel body
37 jack for temporarily support of inward part of shaft 19
38 hole in shaft 19 for giving room for the securing bolt 26
39 lower end of collar for alternative shaft support
40 U-shaped collar for outer shaft support 45
41 gap between shaft and collar on the underside of the shaft
42 plate section of alternative shaft support
43 transition area between collar 40 and thin portion/plate section 42
44 collar for shaft support of bearing support structure located above the turret bearing
45 alternative outer shaft support (alternative version suitable for turntable)
46 connection for outward shaft support 45 to the bearing support structure 17'
47 gap between shaft and U-shaped collar on the underside of the shaft
48 transition between thin part of outer shaft suspension and extension down into the support structure
49 plate part of suspension structure extending into the bearing support structure
50 horizontal extension of the lower portion of the suspension structure for connection with the deck in the support structure.
51 joint in side of the lower portion of the suspension structure 66 for welding to the shell of the support structure 17, the extension of the turret barrel 12
52 edge in side of the suspension structure 21
53 collar side
54 tapped bolt hole in shaft (for nut bolts)
55 axial surface on nut 31, inner diameter face for mating onto the inward portion of the surface 58 (located at the inner end of the shaft 19)
56 axial surface on nut 31, outer diameter face
57 bearing liners on shaft, location for the axial wheel on the shaft
58 axial inward face on shaft (for mating the nut under bolt tension at the less diameter, and with the reinforcement 30 at the larger diameter)
59 radial face on nut (to mate with the face 60 in the recessed portion 33 of the shaft 19
60 radial face in the recess 33 of the shaft for mating with the radial face 59 of the nut (this centralized the nut and the shaft)
61 radial face on nut (to mate with the radial face 62 for centralizing the shaft in the reinforcement 30)
62 radial face on reinforcement 30
63 axial face on reinforcement 30 to mate with nut face 56
64 inner shaft anchoring point
65 joint on suspension structure for welding to the bearing support structure 17
66 lower part of the suspension structure
67—collar mating face with the shaft 19
68 axial face on reinforcement 30, facing outward to mate with shaft face 58
69 axial face in recessed portion 33 in end of shaft, facing inward
70 downward face in collar slot
71 glide Bearing Assembly
72 circular glide way
73 outer suspension structure for shaft with a rectangular cross section
74 shaft with rectangular cross section
75 connection between the suspension structure 73 and turret bearing support structures/turret structures
76 inner support for the shaft in the turret support structure
77 nut connection between the shaft and the support structure
78 glide bearing pad
79 convex part of spherical joint 71
80 bearing assembly comprising flexible shaft in outer shaft suspension and bearing unit
81 clearance between underside of rectangular shaped shaft and outer suspension structure
82 side edge of the suspension structure 73
83 collar part of suspension structure for rectangular shaft
84 concave part of the spherical joint 71
85 push out bolt
86 turret structure
87 turret center line
88 bearing support structure on vessel

The invention claimed is:

1. A suspension of axial turret bearing units in a turret bearing, the suspension comprising:
- a rail support structure mounted on a turret bearing support structure,
- a circular rail mounted to the rail support structure,
- a plurality of axial bearing units running on the circular rail,
- a shaft for each of the plurality of axial bearing units, each shaft having an outer end,
- an inner end, a length, a width, and a height, with the axial bearing unit attached to the outer end of the shaft,
- an inner support structure for supporting the inner end of each shaft,
- an outer shaft suspension close to each axial bearing unit, each outer shaft suspension comprising:
  - a flexible collar with an inner width similar to the width of the shaft and an inner height substantially higher than the height of the shaft,
  - a transitional section connected to the flexible collar,
  - a plate section connected to the transitional section and fastened to a bearing support structure on a turret,
  - wherein the plate section spreads applied loads on the bearing support structure, wherein the transitional section of the outer shaft suspension is as thick as the flexible collar, close to the collar and tapers off to a thickness similar to a thickness of the plate section closer to the plate section; the width of the plate section, in a tangential direction of the turret, is wider than the width of the flexible collar and a width of the transitional section; and the plate section is fastened to the bearing support structure, a releasable inner shaft anchoring point for connecting the shaft to the inner support structure, wherein the shaft is terminated outside the inner support structure.

2. The suspension of axial turret bearing units in a turret bearing according to claim 1 wherein the releasable inner shaft anchoring point comprises a reinforcement around a hole in the inner support structure located at the inner end of the shaft, and a nut, with a shape complimentary to the reinforcement which is clamped to the inner end of the shaft by bolts, thus locking the shaft to the inner support structure.

3. The suspension of axial turret bearing units in a turret bearing according to claim 1, wherein a recessed portion at an end face of the inner end of the shaft has a radial face centralizing the shaft with a complementary face on the nut.

4. The suspension of axial turret bearing units in a turret bearing according to claim 1 wherein the axial turret bearing units are wheels.

5. The suspension of axial turret bearing units in a turret bearing according to claim 1 wherein the axial turret bearing units are glide bearing assemblies.

6. The suspension of axial turret bearing units in a turret bearing according to claim 1 wherein the bearing support structure is below the turret bearing and the outer shaft suspension handles tensile forces.

7. The suspension of axial turret bearing units in a turret bearing according to claim 1 wherein the bearing support structure is above the turret bearing and the outer shaft suspension handles compressive forces.

8. The suspension of axial turret bearing units in a turret bearing according to claim 7 wherein the flexible collar is cut at the height of a lower side of the shaft.

9. The suspension of axial turret bearing units in a turret bearing according to claim 4 wherein the wheels are fastened to the shafts by a sliding bearing assembly allowing a limited movement of the wheels along the length of the shaft.

10. The suspension of axial turret bearing units in a turret bearing according to claim 1 wherein the shaft has a shape tapering away in each direction from the outer shaft suspension.

11. The suspension of axial turret bearing units in a turret bearing according to claim 1 wherein the shaft has a circular cross section.

12. The suspension of axial turret bearing units in a turret bearing according to claim 1 wherein the shaft has a rectangular cross section.

13. The suspension of axial turret bearing units in a turret bearing according to claim 1 wherein a securing bolt passes through a hole in the shaft located on an inner side of the flexible collar and extending past the flexible collar.

14. A method for dismounting and mounting an axial shaft and turret bearing unit of a suspension of axial turret bearing units in a turret bearing, the suspension comprising:

a rail support structure mounted on a turret bearing support structure, a circular rail mounted to the rail support structure, a plurality of axial bearing units running on the circular rail, a shaft for each of the plurality of axial bearing units, each shaft having an outer end, an inner end, a length, a width, and a height, with the axial bearing unit attached to the outer end of the shaft, an inner support structure for supporting the inner end of each shaft, an outer shaft suspension close to each axial bearing unit, each outer shaft suspension comprising:

a flexible collar with an inner width similar to the width of the shaft and an inner height substantially higher than the height of the shaft, a transitional section connected to the flexible collar, a plate section connected to the transitional section and fastened to a bearing support structure on a turret, wherein the plate section spreads applied loads on the bearing support structure, a releasable inner shaft anchoring point for connecting the shaft to the inner support structure, wherein the shaft is terminated outside the inner support structure;

the method comprising:

a) locking the turret in a fixed rotational position, b) using a jack to jack up the inner end of the shaft to take a load off the inner end of the shaft, c) removing a nut from inner end of the shaft, d) removing a locking bolt from a hole in the shaft, e) removing the jack, f) removing the shaft and bearing unit, wherein mounting the axial shaft and turret bearing unit comprise a-g in reverse order except that e and b change places.

15. The suspension of axial turret bearing units in a turret bearing according to claim 2, wherein a recessed portion at an end face of the inner end of the shaft has a radial face centralizing the shaft with a complementary face on the nut.

16. A suspension of axial turret bearing units in a turret bearing, the suspension comprising:

a rail support structure mounted on a turret bearing support structure, a circular rail mounted to the rail support structure, a plurality of axial bearing units running on the circular rail, wherein the plurality of axial turret bearing units are glide bearing assemblies;

a shaft for each of the plurality of axial bearing units, each shaft having an outer end, an inner end, a length, a width, and a height, with the axial bearing unit attached to the outer end of the shaft, an inner support structure for supporting the inner end of each shaft, an outer shaft suspension close to each axial bearing unit, each outer shaft suspension comprising:

a flexible collar with an inner width similar to the width of the shaft and an inner height substantially higher than the height of the shaft, a transitional section connected to the flexible collar, a plate section connected to the transitional section and fastened to a bearing support structure on a turret, wherein the plate section spreads applied loads on the bearing support structure, a releasable inner shaft anchoring point for connecting the shaft to the inner support structure, wherein the shaft is terminated outside the inner support structure.

17. A suspension of axial turret bearing units in a turret bearing, the suspension comprising:

a rail support structure mounted on a turret bearing support structure, a circular rail mounted to the rail support structure, a plurality of axial bearing units running on the circular rail, a shaft for each of the plurality of axial bearing units, each shaft having a rectangular cross section, an outer end, an inner end, a length, a width, and a height, with the axial bearing unit attached to the outer end of the shaft, an inner support structure for supporting the inner end of each shaft, an outer shaft suspension close to each axial bearing unit, each outer shaft suspension comprising:

a flexible collar with an inner width similar to the width of the shaft and an inner height substantially higher than the height of the shaft, a transitional section connected to the flexible collar, a plate section connected to the transitional section and fastened to a bearing support structure on a turret, wherein the plate section spreads applied loads on the bearing support structure, a releasable inner shaft anchoring point for connecting the shaft to the inner support structure, wherein the shaft is terminated outside the inner support structure.

18. A suspension of axial turret bearing units in a turret bearing, the suspension comprising:

a rail support structure mounted on a turret bearing support structure, a circular rail mounted to the rail support structure, a plurality of axial bearing units running on the circular rail, a shaft for each of the plurality of axial bearing units, each shaft having an outer end, an inner end, a length, a width, and a height, with the axial bearing unit attached to the outer end of the shaft, an inner support structure for supporting the inner end of each shaft, an outer shaft suspension close to each axial bearing unit, each outer shaft suspension comprising:

a flexible collar with an inner width similar to the width of the shaft and an inner height substantially higher than the height of the shaft, wherein a securing bolt passes through a hole in the shaft located on an inner side of the flexible collar and extending past the flexible collar, a transitional section connected to the flexible collar, a plate section connected to the transitional section and fastened to a bearing support structure on a turret, wherein the plate section spreads applied loads on the bearing support structure, a releasable inner shaft anchoring point for connecting the shaft to the inner support structure, wherein the shaft is terminated outside the inner support structure.

* * * * *